US006380697B1

(12) United States Patent
Herter et al.

(10) Patent No.: US 6,380,697 B1
(45) Date of Patent: Apr. 30, 2002

(54) RADIATOR MODULE FOR USE IN A LAMP HOUSING

(75) Inventors: Beate Herter, Karlsruhe; Anke Schnabl, Hammersbach; Karsten Ernesti, Hanau; Dieter Steck, Ostildern, all of (DE)

(73) Assignee: Heraeus Noblelight GmbH, Hanau (DE)

( * ) Notice: Subject to any disclaimer, the term of this patent is extended or adjusted under 35 U.S.C. 154(b) by 0 days.

(21) Appl. No.: 09/727,082

(22) Filed: Nov. 30, 2000

(30) Foreign Application Priority Data

Oct. 3, 2000 (DE) ..... 200 04 366 U

(51) Int. Cl.[7] ..... H01J 61/30

(52) U.S. Cl. ..... 315/344; 315/246; 315/321; 313/609; 362/238; 362/244

(58) Field of Search ..... 315/326, 338, 315/246, 248, 267, 344; 313/609–612, 634, 573; 362/227–229, 238–240, 250, 372, 244

(56) References Cited

U.S. PATENT DOCUMENTS

| | | | | | |
|---|---|---|---|---|---|
| 4,428,029 | A | * | 1/1984 | Baliozian | 362/12 |
| 4,464,705 | A | * | 8/1984 | Horowitz | 362/12 |
| 5,801,495 | A | | 9/1998 | Smolka et al. | 315/326 |
| 5,814,951 | A | | 9/1998 | Smolka et al. | 315/326 |
| 6,022,123 | A | * | 2/2000 | Tomioka et al. | 362/228 |

FOREIGN PATENT DOCUMENTS

| | | |
|---|---|---|
| DE | 20 29 317 A | 12/1971 |
| DE | 195 47 813 A | 6/1997 |
| DE | 195 47 813 C2 | 6/1997 |
| DE | 195 47 519 A1 | 7/1997 |
| EP | 0 657 685 A | 6/1995 |
| GB | 2 298 055 A | 8/1996 |

* cited by examiner

*Primary Examiner*—Haissa Philogene
*Assistant Examiner*—Ephrem Alemu
(74) *Attorney, Agent, or Firm*—Fulbright & Jaworski L.L.P.

(57) ABSTRACT

For insertion into a lamp housing, a radiator module (1) is provided inside of the module with at least one discharge lamp as radiation source, which puts out an ultraviolet radiation produced by plasma within a discharge chamber (2), the plasma being formed by coupling an electromagnetic field into the discharge chamber (2) and the radiation produced by the plasma exits along a given optical axis through at least one body (12) transparent to ultraviolet radiation as a window. In the range of the plasma at least one diaphragm opaque to radiation is provided with a through-bore along the axis (6), an additional thermal radiation source is fixedly arranged in a given position within the module along the optical axis (6); the additionally produced radiation penetrates through a second transparent body (13) as entry window into the discharge chamber, and then exits along the axis through the first transparent body (12) together with the ultraviolet radiation produced by the plasma. The module (1) can be inserted into a mounting of the lamp housing with a coupling lens (10), and is locked and held in a given position within the mounting by the mating fit of the module with respect to the coupling lens.

12 Claims, 2 Drawing Sheets

RADIATOR MODULE FOR USE IN A LAMP HOUSING

BACKGROUND OF THE INVENTION

The invention relates to a radiator module for insertion into a lamp housing with at least one discharge lamp situated in the interior of the module as radiation source, which emits ultraviolet radiation produced by plasma within a discharge space, the plasma being formed by coupling an electromagnetic field in the discharge space, and the radiation produced by the plasma issues along a given optical axis through at least a first body transparent to ultraviolet radiation as a window, at least one diaphragm with a through-bore being provided along the axis in the area of the plasma, and along this axis radiation produced by an additional radiation source penetrates into the discharge space through a second transparent body as an entrance window and exits along the axis through the first transparent body together with the ultraviolet radiation produced by the plasma.

DE 195 47 519 A1 and the corresponding U.S. Pat. No. 5,814,951 A disclose an electrode-less low-pressure discharge lamp, especially a deuterium lamp, which has a cylindrically symmetrical diaphragm body which contains a cavity at each of its end faces. The two cavities are connected together by a bore which serves as a diaphragm aperture in order to constrict the plasma produced by coupling a high-frequency electromagnetic field in the interior for the purpose of increasing the intensity of the output radiation. Each end of the cylindrically symmetrical diaphragm body is provided with a hermetic seal, at least one of these seals being configured as an exit window. In a preferred embodiment the coupling of the electromagnetic field is performed capacitively by electrodes situated on the end faces and having at least one opening for the exit of the radiation, if they are adjacent to an outlet window.

In a special embodiment the diaphragm body has a bore passing through both ends along the optical axis with an opening passing through one of the electrodes, each of the openings being disposed adjacent abeam exit window. Along the beam axis an additional radiation source is disposed, radiation of the additional radiation source being also passed through the diaphragm exit opening.

In DE 195 47 813 C2 an electrode-less discharge lamp with diaphragm body is likewise disclosed. In the discharge vessel a plasma is formed by producing a high-frequency electromagnetic field and radiation produced by the plasma passes out from the discharge vessel through a part of the discharge vessel which is permeable at least to ultraviolet rays, at least one diaphragm body of heat-resistant material being disposed in the area of the plasma and having at least one opening for the constriction of the plasma area. In the plasma area at least two diaphragm apertures are provided on an optical axis along which the radiation exits, the discharge vessel being provided along the beam axis at each of its ends with a flat electrode for the capacitive coupling of the electromagnetic field. At the same time at least one of the electrodes contains an opening in the area of the axis of the beam exit, which is disposed adjacent an exit window permeable to ultraviolet rays.

SUMMARY OF THE INVENTION

The known discharge lamps have proven problematic with regard to complete UV-Vis light sources for analytic purposes, a lamp unit having a deuterium and a tungsten lamp in a translucent arrangement which contains, together with shutters, an SMA fiber optic connection and an input apparatus for both lamps on a circuit board. In systems with a connecting lens—for light-wave conductors—a readjustment must be performed when the lamp has to be replaced.

The invention is addressed to the problem of finding a very simple and handy radiation source as a module which will be suitable for printed circuit board construction, with fiber optic coupling. Also, the radiation source is to be replaceable in a comparatively simple manner, the replaced module being correctly adjusted.

The problem is solved in that the additional radiation source is fixedly disposed in a given position along the optical axis, the module being insertable into a mounting of the lamp housing with a coupling lens, and is locked within the mounting by the mating fit of the module in a given position with respect to the coupling lens.

Advantageous embodiments of the invention are given in claims 1 to 12.

In a preferred embodiment the module has, for the purpose of locking, a ring-shaped adjusting element in the area of its end facing the coupling lens, which is fixedly set in a defined position with respect to the first transparent body and the optical axis of the module.

Preferably the adjusting element reaches into a recess in the mounting for the coupling lens.

In a preferred embodiment an adjusting ring is provided as the adjusting element, which is fixed in the recess by means of a screw.

A heat radiator is provided as an additional radiation source, an incandescent lamp being used as additional radiation source.

For the creation of the electromagnetic field, electrodes are provided outside of the discharge space, but they form one structural unit with the radiator module. At the same time the electrodes are disposed along the optical axis, and in the area of the optical axis they have openings to admit the radiation. The basic construction of such a discharge system is found in the disclosures DE 195 47 519 and U.S. Pat. No. 5,814,951, or DE 195 47 813 C2.

It proves to be especially advantageous that, after a basic adjustment of the first radiator module in the lamp housing, all of the modules used in exchange are repeatably positioned as regards their position in relation to the coupling lens, so that readjustment is unnecessary. It is thus assured that a radiator module can be replaced by the user without great difficulty.

BRIEF DESCRIPTION OF THE INVENTION

The subject of the invention is further explained below with the aid of FIGS. 1 to 3.

DETAILED DESCRIPTION OF THE INVENTION

Figure 1:
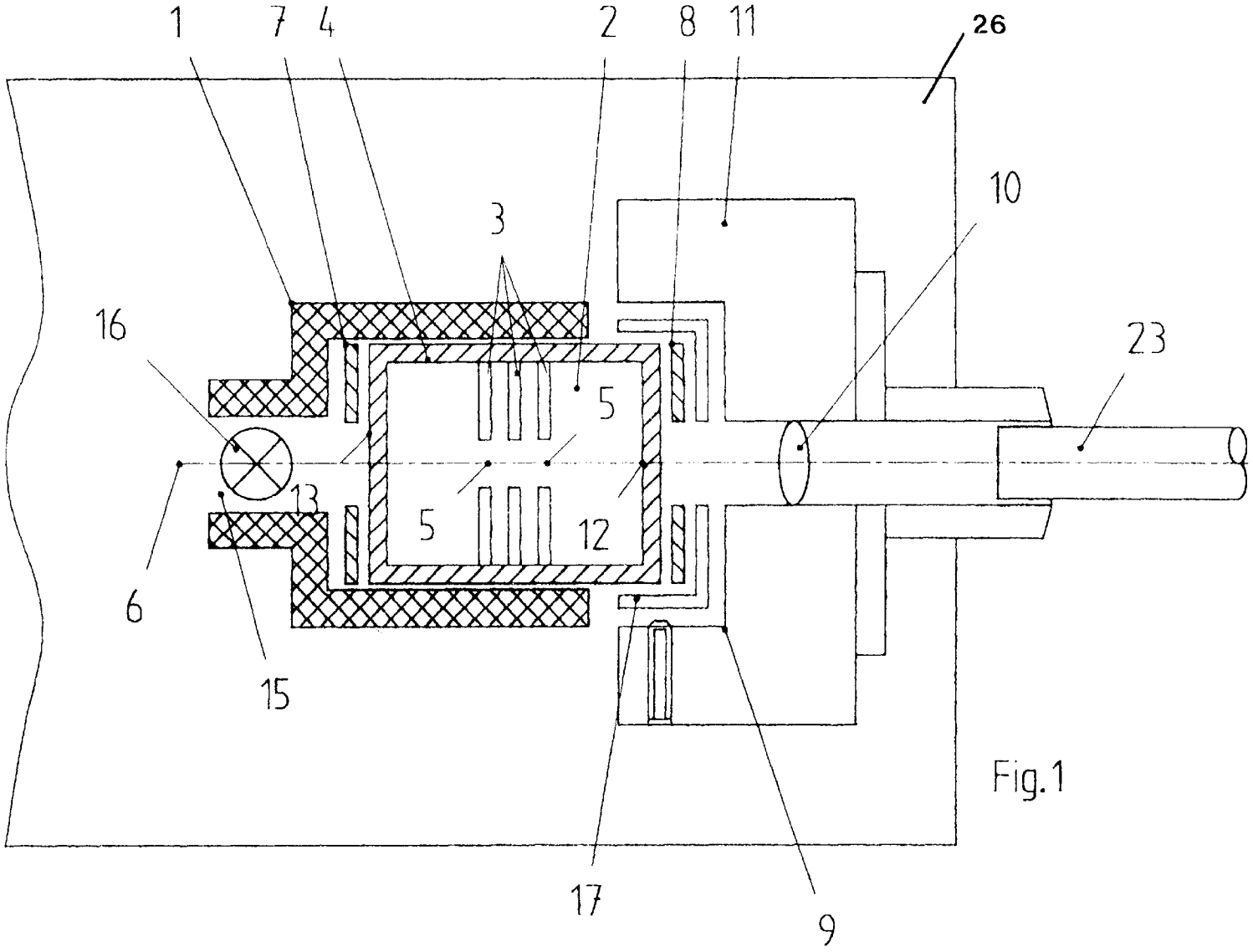
FIG. 1 is a schematic representation of a longitudinal section of the radiator module which is inserted into a mounting belonging to the lamp housing.

According to FIG. 1 the radiator module 1 has a hermetically sealed discharge chamber 2 with an envelope of quartz glass 4 which contains in its interior three diaphragms 3 of refractory material, such as molybdenum or tungsten for example, the diaphragms having each an opening 5 along an optical axis 6. To excite the discharge, electrodes 7 and 8 are provided inside of the radiator module 1 but are separated from the discharge chamber 2 by a dielectric (quartz glass). Along the optical axis 6 there can be seen a first transparent body 12 as a window that is permeable (quartz glass) to ultraviolet radiation, through which the radiation passes, which is produced in the discharge chamber 2 as a plasma within the openings 5 by means of electromagnetic excitation and enters into the recess 9 of the mounting 11 for the coupling lens 10. The coupling lens 10 supplies a connected light wave conductor 23 (shown broken) with radiation exiting the radiator module 1. Along the optical axis 6 the radiator module 1 has an additional transparent body 13 as a second window (quartz glass) which divides the discharge chamber 2 from a chamber 15 to accommodate an incandescent lamp 16 as a heat radiator. The transparent body 13 is permeable at least to visible radiation and infrared radiation, while the first transparent body 12 must additionally also be permeable to ultraviolet radiation.

The incandescent lamp 16 configured as a heat radiator produces a spectrum which adjoins the UVA range and extends to the infrared range, while the UV radiation produced in the discharge chamber 2 has the spectral range of UV-A, UV-B and UV-C. The radiator module 1 has a circumferential ring 17 affixed to the radiator module 1 near the coupling lens 10, the position of which is adjusted with respect to the optical axis 6 and the adjoining coupling lens 10 such that the radiation from the incandescent lamp 16 and from the discharge chamber 2 is optimized on the way to the coupling lens 10 such that it can enter without great loss into the light wave conductor 23.

On account of the initial adjustment by means of ring 17 and a recess, not visible here, in the radiator module 1, a lasting adjustment is formed, which remains preserved even if a radiator module 1 is replaced, without the need for any kind of readjusting operations when a new radiator module is used. The mounting 11 is fastened on a conductor plate 26 on which the corresponding electronics are contained.

Figure 2:
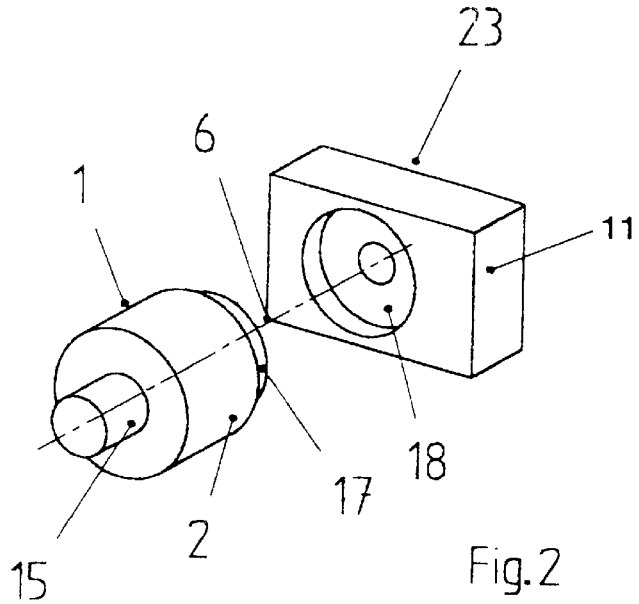
FIG. 2 shows schematically how the radiator module is installed in the mounting with an coupling lens for the light conductor.
Figure 3:
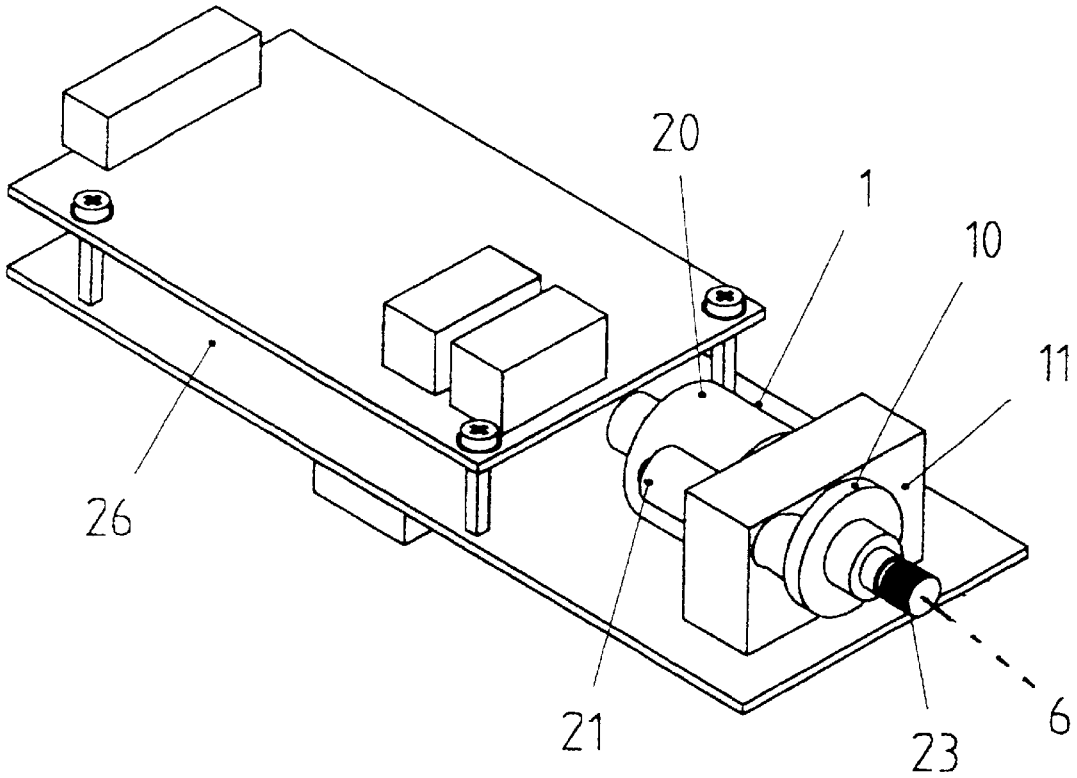
FIG. 3 is a perspective, schematic representation of the arrangement of the radiator module and its mounting; also seen is the end of the light conductor connection (SMA) facing away from the radiator module.

In FIG. 2 can be seen the mounting 11 for the coupling lens 10 (according to FIG. 1) with its recess 18 into which the radiator module 1 is introduced partially such that the circumferential ring 17 provided for the adjustment is fitted into the recess 18 and locked in this position in the mounting 11 by means of a screw 21 visible in FIG. 3. Ring 17 is positioned in relation to the rest of the radiator module 1 by means of a recess, here not seen, in the radiator module 1 such that, after the radiator module 1 is introduced into mounting 11, an optimal adjustment of the lamp system is always assured.

In FIG. 3 can be seen the mounting 11 disposed on a circuit board 26 for the locking of radiator module 1. The incandescent lamp not seen here is disposed along the optical axis 6 and locked in the lamp chamber 15 (FIG. 1), and the radiation produced also issues along the axis 6 and is guided through both of the transparent bodies (quartz glass) configured as windows of the discharge chamber. The ultraviolet radiation produced by plasma balls in the area of the diaphragm openings 5 (FIG. 1) likewise passes along the optical axis 6 through the first transparent body 12 (quartz glass window) into the coupling lens 10 from where it is guided into a light wave conductor 23, here represented as broken.

What is claimed is:

1. Radiator module for insertion into a lamp housing with at least one discharge lamp as radiation source situated in the interior of the module which puts out an ultraviolet radiation produced by means of plasma in the interior of a discharge chamber, the plasma being formed by coupling an electromagnetic field into the discharge chamber and the radiation produced by the plasma issues along a given optical axis through at least a first body transparent to ultraviolet radiation as a window, at least one diaphragm with a through-bore is provided along the axis in the range of the plasma, and radiation produced along this axis by an additional radiation source penetrates through a second transparent body as an entry window into the discharge chamber, and exits along the axis through the first transparent body together with the ultraviolet radiation produced by the plasma, characterized in that the additional radiation source is fixedly disposed in a given position within the module along the optical axis the module being insertable into a mounting of the lamp housing with a coupling lens and locked and held in a given position with respect to the coupling lens by the mating fit of the module.

2. A radiator module according to claim 1, wherein the module has an annular adjusting element which is fixedly held in a defined position with respect to the first transparent body as exit window and the optical axis of the module.

3. The radiator module according to claim 2, wherein said adjusting element engages in a recess of the mounting for the coupling lens.

4. The radiator module according to claim 1, wherein said adjusting element is an adjusting ring which is fixed in said recess with a screw.

5. The radiator module of claim 1, wherein said discharge chamber is surrounded by quartz glass.

6. The radiator module of claim 1, wherein the diaphragms situated in the discharge chamber consist of molybdenum or tungsten.

7. The radiator module of claim 1, wherein the discharge chamber is filled with deuterium using a cold fill pressure in the range from 5 mbar to 200 mbar.

8. The radiator module according to claim 1, wherein electrodes are situated outside of the discharge chamber to couple the electromagnetic field.

9. The radiator module according to claim 8, wherein the electrodes are arranged along the optical axis of the module having openings in the area of the optical axis for the passage of rays.

10. The radiator module according to claim 1, wherein a temperature radiator is provided as an additional radiation source.

11. The radiator module according to claim 10, wherein an incandescent lamp is provided as additional radiation source.

12. The radiator module according to claim 1, wherein the housing of the module is a temperature-resistant plastic.

* * * * *